US006442850B1

(12) United States Patent
Coffin

(10) Patent No.: US 6,442,850 B1
(45) Date of Patent: Sep. 3, 2002

(54) SHAVING RAZOR USING BLADE CARTRIDGE AND BLADE CARTRIDGE THEREFOR

(75) Inventor: David C. Coffin, Milford, CT (US)

(73) Assignee: Pfizer Inc., New York, NY (US)

( * ) Notice: Subject to any disclaimer, the term of this patent is extended or adjusted under 35 U.S.C. 154(b) by 0 days.

(21) Appl. No.: 09/796,133

(22) Filed: Feb. 28, 2001

(51) Int. Cl.[7] ..... B26B 21/22; B26B 21/52
(52) U.S. Cl. ..... 30/532; 30/533
(58) Field of Search ..... 30/532, 533, 527, 30/78, 47, 34.2

(56) References Cited

U.S. PATENT DOCUMENTS

| | | | | |
|---|---|---|---|---|
| 3,935,639 A | | 2/1976 | Terry et al. | 30/47 |
| 4,170,821 A | | 10/1979 | Booth | 30/47 |
| 4,860,449 A | * | 8/1989 | Duncan | 30/47 |
| 5,056,222 A | | 10/1991 | Miller er al. | 30/47 |
| 5,966,822 A | | 10/1999 | Coffin et al. | 30/541 |
| 6,112,412 A | | 9/2000 | Richard | 30/41.5 |
| 6,138,361 A | | 10/2000 | Richard et al. | 30/50 |

* cited by examiner

*Primary Examiner*—Douglas D. Watts
(74) *Attorney, Agent, or Firm*—Peter C. Richardson; Gregg C. Benson; Raymond D. Thompson

(57) ABSTRACT

In a shaving razor using a blade cartridge, the reusable assembly of the razor includes a guard element and the blade cartridge is designed with no parts located in front of the blade edge or edges, and when the blade cartridge is installed in the reusable assembly, the guard element of the reusable assembly becomes located in front of the blade edge or edges of the blade cartridge to cooperate with the blade edges in a customary way to stretch the skin and erect the beard hairs in advance of the cutting edge. The blade cartridge is also movable about two different pivot axes to improve the safety of the razor during use.

21 Claims, 5 Drawing Sheets

SHAVING RAZOR USING BLADE CARTRIDGE AND BLADE CARTRIDGE THEREFOR

FIELD OF THE INVENTION

This invention relates to shaving razors of the type including a reusable assembly, usually made up of a handle and blade cartridge holding housing, and a blade cartridge replaceably insertable into the reusable assembly, with the reusable assembly usually being of relatively expensive construction and the blade cartridge being of a low cost construction so that the reusable assembly can be successively used with a plurality of the blade cartridges with each cartridge intended to being thrown away as an expendable item after having been worn to an unsatisfactory degree of performance, and deals more particularly with improvements in such a shaving razor.

BACKGROUND OF THE INVENTION

Present day shaving razors using replaceable blade cartridges comprise a number of different members that wear at different rates during use. These include a guard member usually in the form of an elongated flexible guard element to stretch the skin and to erect the beard hair, one or more blade edges, and a cap member often housing a depletable shaving aid such as an elongated body made up of or containing a skin treatment agent which is released from the body and transferred to the skin as the body passes over the skin during a shaving operation. Specific examples of suitable forms of shaving aids are disclosed in U.S. Pat. Nos. 4,170,821, 5,711,076, and 6,161,217 to which reference may be made for further details. At the present time, a commonly used and perhaps "standard" shaving aid is one made of a body of hydrophilic polymers, in particular polyethylene oxide in a matrix of another polymer, with the body also containing traces of further treatment agents such as aloe and vitamin E.

It, therefore, becomes desirable to the manufacturer and to the consumer to have those parts subject to rapid wear to be replaceable ones, and in particular to be part of the replaceable blade cartridge, and to have the longer lasting parts be essentially non-replaceable and in particular to be part of the reusable assembly where they can perhaps with economical justification be made better and still more longer lasting than they could be if made part of the replaceable blade cartridge.

Further, in many instances of shaving razors using replaceable blade cartridges, the blade cartridges are held stationery relative to the reusable assembly, and it is known that for safety purposes, some improvement can be obtained by providing the blade cartridge with some degree of pivotal freedom of movement about a pivot axis parallel to the cutting edge or edges of the cartridge, yet still further improvements in regard to safety are desirable.

An object of the invention is, therefore, to provide a shaving razor using a replaceable blade cartridge in cooperation with a reusable assembly wherein the parts most subject to wear are formed as part of the blade cartridge and parts less subject to wear are provided as part of the reusable assembly.

In keeping with the above object, a more specific object is to provide a shaving razor of the aforementioned kind wherein each blade cartridge includes one or more blades and optionally a depletable shaving aid; and wherein a shaving guard is provided as part of the reusable assembly which shaving guard, when a blade cartridge is inserted into the reusable assembly, is located forwardly of the blade or blades to stretch the skin and erect beard hairs in advance of the blades as the cartridge is moved by the reusable assembly in a shaving direction.

A further object of the invention is to improve the safety of the aforementioned shaving razor by providing the replaceable blade cartridge with two different pivotal freedoms of movement relative to the reusable assembly about two different pivot axes.

SUMMARY OF THE INVENTION

The invention resides in a shaving razor comprising basically a reusable assembly movable in a shaving direction by a user's hand and having a guard element, and a replaceable blade cartridge with at least one blade having an elongated cutting edge. The reusable assembly and the blade cartridge have cooperating catch parts allowing the blade cartridge to be brought into and out of an installed condition relative to the reusable assembly. The blade cartridge itself has no elongated guard located directly ahead of and parallel to the cutting edge or edges of its blade or blades, and when the cartridge is installed in the reusable assembly the guard element of the reusable assembly becomes located directly in front of the blade or blades of the blade cartridge and in a shaving operation functions in the normal fashion of a guard element even though the guard element is not itself a part of the blade cartridge.

The invention also resides in the reusable assembly including a sub-seat for holding a replaceable blade cartridge which sub-seat has a downwardly extending recess for receiving a downwardly extending protrusion of the replaceable blade cartridge and which sub-seat is held by the housing of the reusable assembly for rotation about a sub-seat pivot axis, the sub-seat carrying the guard element and the sub-seat pivot axis being parallel to and preferably substantially collinear with a guard element axis about which the guard element is substantially arcuate.

The invention still further resides in the sub-seat of the reusable assembly and the blade cartridge being so designed that when the blade cartridge is in the installed position relative to the sub-seat, the blade cartridge is pivotal relative to the sub-seat about a cartridge pivot axis parallel to the sub-seat pivot axis, and in the provision of spring means between the sub-seat and housing and between the blade cartridge and the sub-seat such that when a force is imposed on the blade or blades of the blade cartridge by the blade or blades encountering beard hairs, the force imposed on the blade or blades by the beard hairs will cause the sub-seat to pivot clockwise away from a counterclockwise limit position about the sub-seat pivot axis before the blade cartridge pivots clockwise relative to the sub-seat away from a counterclockwise limit position about the cartridge pivot axis.

The invention still further resides in the construction of the blade cartridge by itself being such that the cartridge includes no guard element or other part located directly in front of the blade or blades and also includes a downwardly extending connector protrusion capable of use in replaceably assembling the cartridge with a reusable assembly of a shaving razor.

Further features and advantages of the invention will be apparent from the following description of a preferred embodiment of the invention and the accompanying drawings and claims.

DETAILED DESCRIPTION OF PREFERRED EMBODIMENT

Figure 1:
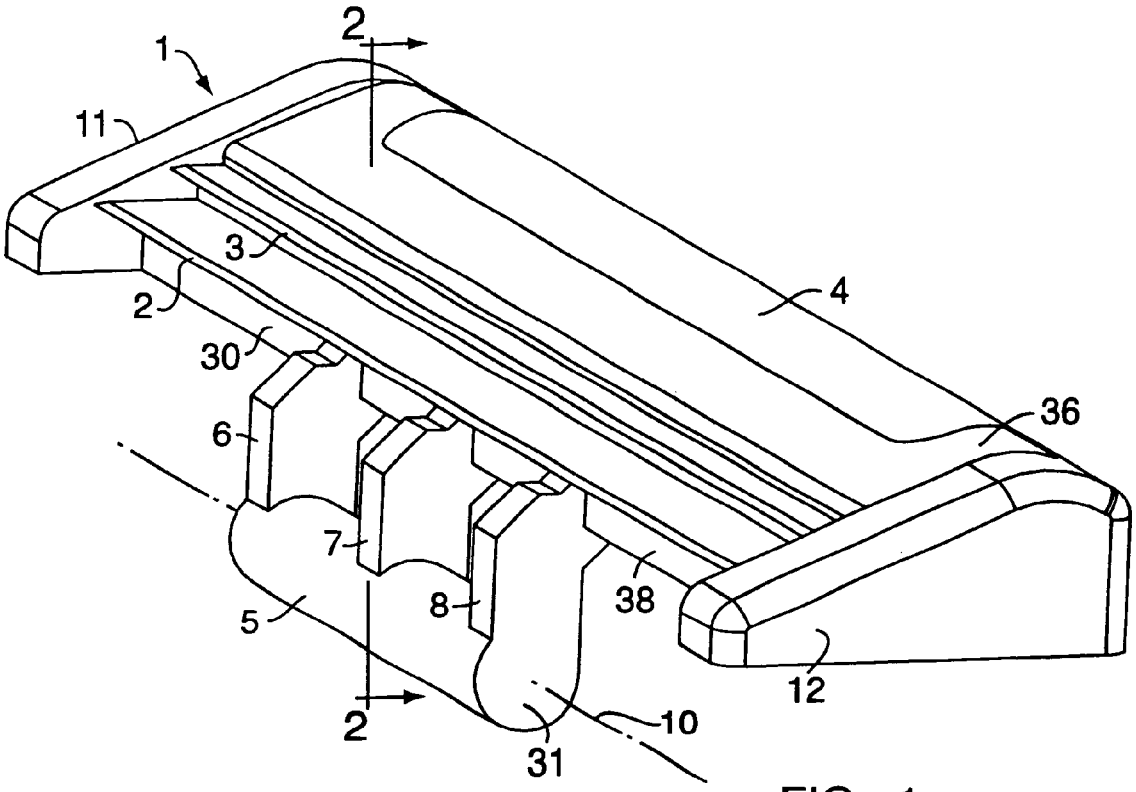
FIG. 1—A perspective view of a blade cartridge embodying the invention.
Figure 2:
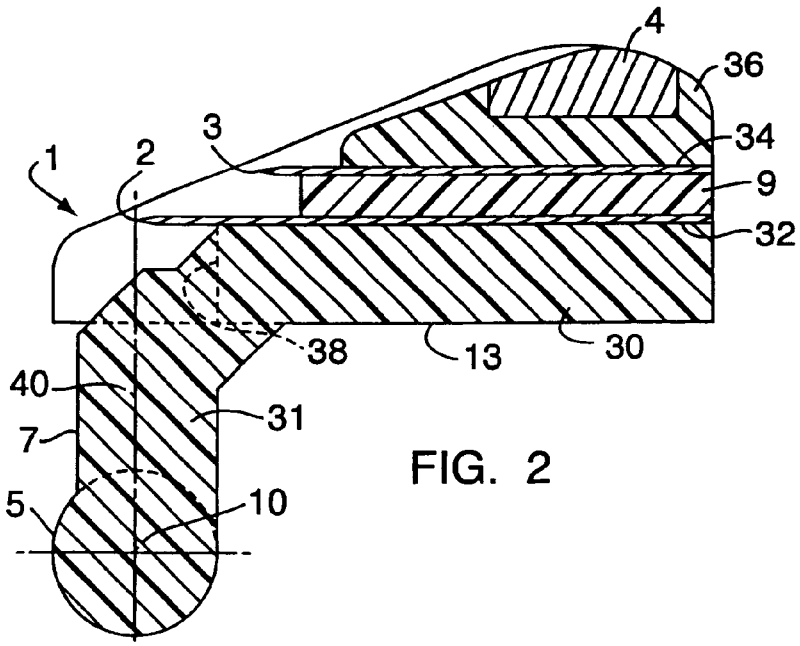
FIG. 2—A vertical sectional view taken on the line 2—2 of FIG. 1.

Referring to FIGS. 1 and 2, a replaceable blade cartridge 1 embodying the invention has a pair of end walls 11, 12, a seat member 30 including a seat body 13 and a downwardly extending connector protrusion 31 made up of three vertical columns 6, 7 and 8 and a horizontally extending cylindrical lower portion 5 having a convexly cylindrical outer surface arcuate about a cartridge axis 10. The cartridge includes two blades 32, 34 having elongated cutting edges 2, 3. The lower blade 32 rests on an upper surface of the seat body 13 and is separated from the upper blade 34 by a spacer 9. A cap 36 rests on top of the upper blade 34 and carries an upwardly exposed shaving aid 4. The shaving aid 4 may be made of any suitable material known in the art, such as, for example, a body as previously mentioned made up of hydrophilic polymers, in particular polyethylene oxide in a matrix of another polymer with the body also containing traces of further treatment agents such as aloe and vitamin E, or any one of the bodies proposed for use as a shaving aid in the previously mentioned patents. The blades 32, 34 may be made of metal or other known suitable materials and the sidewalls 11, 12, seat 30, spacer 9 and cap 36 are preferably made of plastic. The cartridge may be manufactured by conventional "sandwich" type of assembly of a number of individual components or by insert molding. The seat body 13 has a forward edge 38 located rearwardly of the cutting edge 2 of the lower blade 32, and the cartridge axis 10 is parallel to the cutting edge 2 and located at least approximately in a vertical plane 40 also containing the cutting edge 2, as shown in FIG. 2. As seen in FIGS. 1 and 2, the cartridge 1 includes no guard element or other part located in front of the cuffing edges 2, 3.

Figure 3:
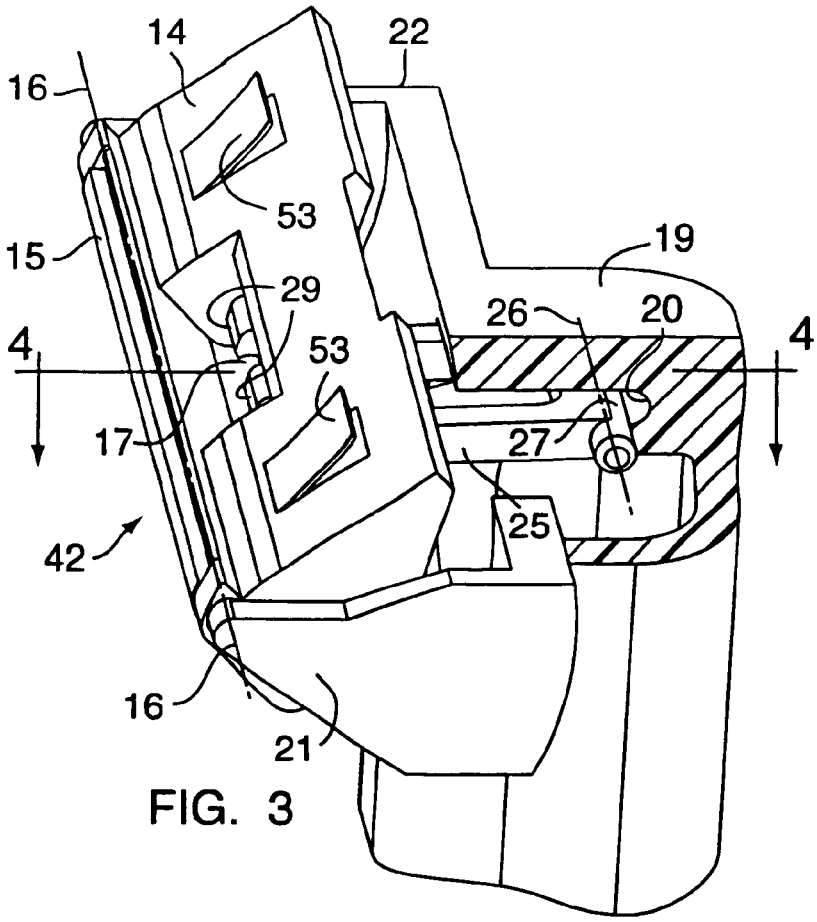
FIG. 3—A fragmentary perspective view of a reusable assembly usable with the blade cartridge of FIG. 1, with portions of the assembly being broken away to reveal the structure of other parts.
Figure 4:
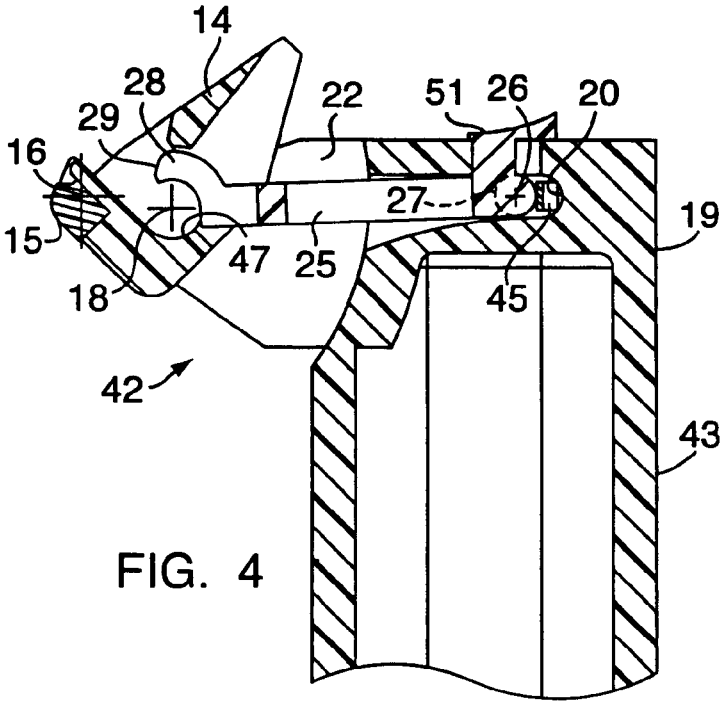
FIG. 4—A vertical sectional view taken on the line 4—4 of FIG. 3.
Figure 3A:
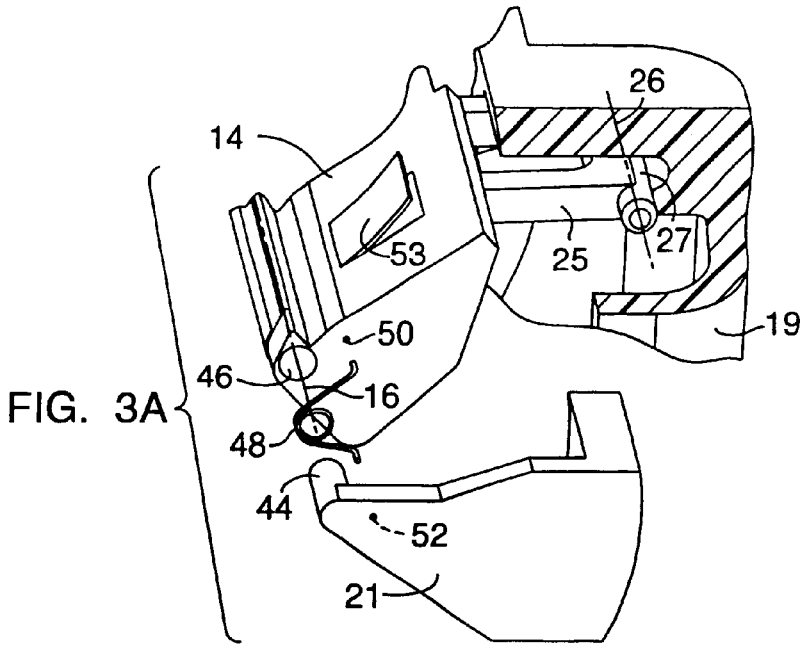

Referring to FIGS. 3 and 4, the reusable assembly for use with the blade cartridge 1 of FIGS. 1 and 2 is indicated generally at 42 and consists basically of a sub-seat 14, a housing 19 and a slider 25. The housing 19 transitions downwardly into a lower portion 43 which itself may be shaped to form a handle or which may be fixed to a separate handle, the handle being grippable by a user's hand to move the razor in customary shaving directions over the user's skin. The sub-seat 14 has an elongated flexible guard element 15 of generally arcuate shape as seen in FIG. 4, and is supported by the housing 19 for rotation about a horizontal axis 16 fixed relative to the carriage. In particular, the sub-seat 14 is located between two arms 21, 22 of the housing 19. The pivotal connection between the housing 19 and the sub-seat 14 includes the arm 21 having a cylindrical stub which is rotatably received by a conforming opening in the adjacent end wall of the sub-seat 14. A helical tension spring is also received on the stub with one arm of the spring fitting into a hole in the sub-seat 14 and an other arm of the spring fitting into a hole in the arm 21. The spring biases the sub-seat counterclockwise relative to the housing about the axis 16 to the neutral position shown in FIGS. 3 and 4 at which movement of the sub-seat in the counterclockwise direction is stopped by suitable co-engageable stop surfaces (not shown) between the sub-seat and the housing. A similar construction is also used between the housing arm 22 and the sub-seat. As shown in FIG. 4, the guard 15 is shaped so that its outer skin engaging surface is curved about an axis of curvature which is at least approximately coincident with the axis 16. The sub-seat 14 also has, centered between its ends, a generally downwardly extending recess 17 having a concavely cylindrically shaped bottom surface 47 centered on axis 18 as seen in FIG. 4.

Figure 7:
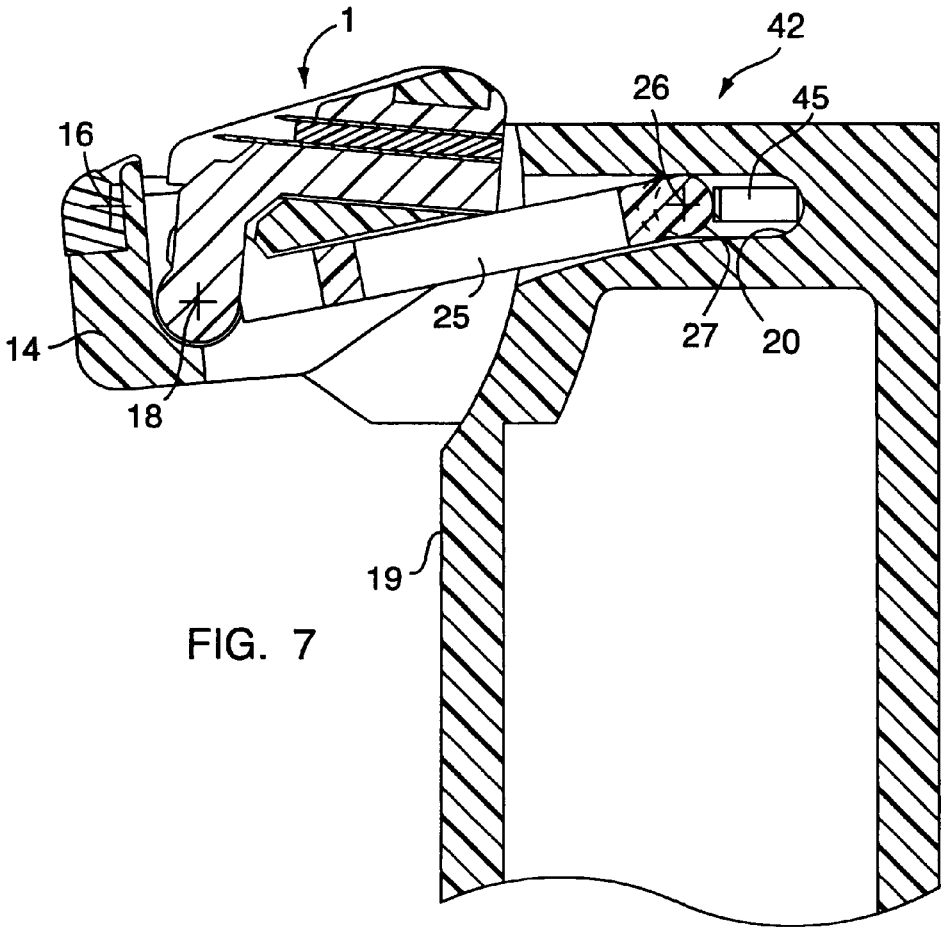
FIG. 7—A vertical sectional view similar to FIG. 6 but with the sub-seat and the blade cartridge being shown in their clockwise limited positions.

From the neutral or counterclockwise limited position shown in FIGS. 3 and 4, the sub-seat 14 is pivotal clockwise about the axis 16 to a clockwise limited position shown in FIG. 7. The full range of movement of the sub-seat between its counterclockwise and clockwise limited positions is represented by the angle A in FIG. 6 and is equal to approximately 40°.

Figure 6A:
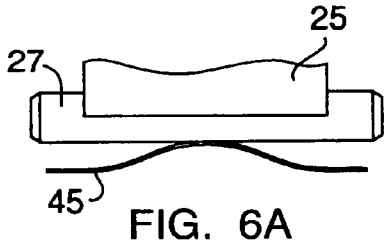
FIG. 6A—A plan view of the rear portion of the slider of FIG. 3.
Figure 6:
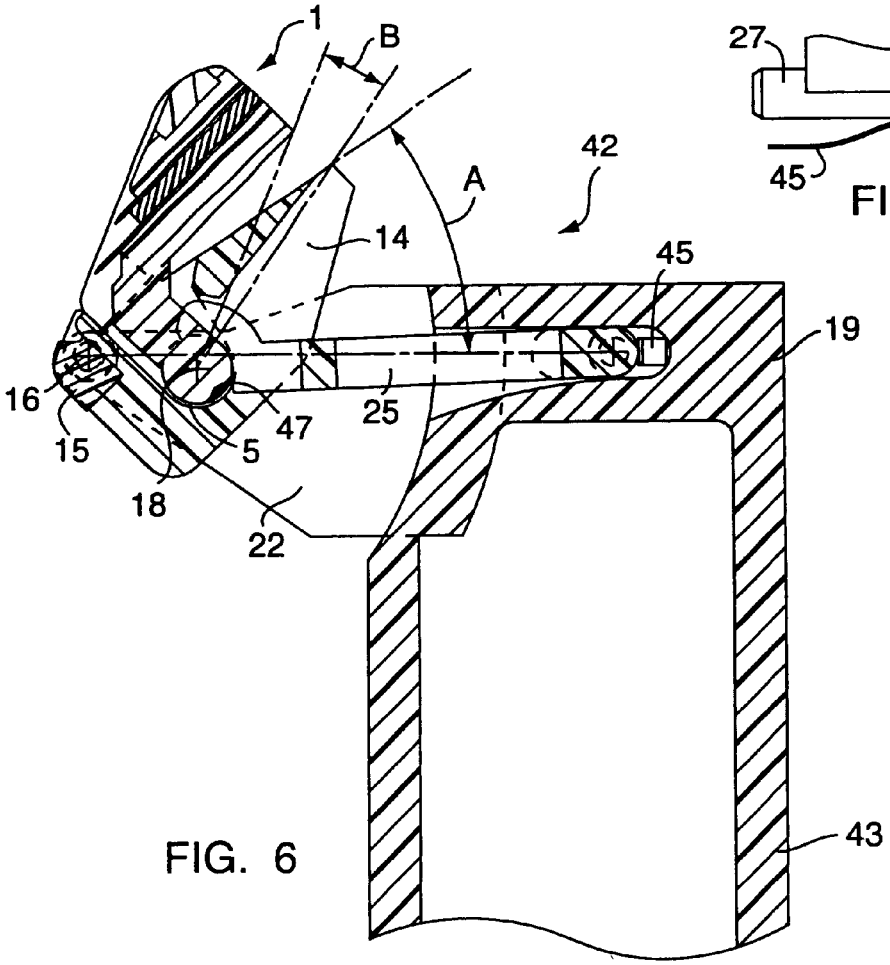
FIG. 6—A vertical sectional view taken on the line 6—6 of FIG. 5 with the sub-seat of the reusable assembly and the blade cartridge being shown in their counterclockwise limited pivotal positions.

The slider 25 is received in a slot 20 of the housing 19 which slot extends essentially parallel to the axis 16. The slider itself comprises an elongated cylindrical portion 27 having an axis 26. At its other or left-hand end, as seen in FIGS. 3 and 4, the slider has a partially cylindrical hook or catch portion 28 which is centered on an axis 18 when the slider is in the forward position shown in FIG. 4. As seen in FIG. 6A, the slider 25 has leaf-spring elements 45 extending rearwardly from the cylinder 27 which bias the slider 25 forwardly or to the left as seen in FIG. 6. Under applied forces, the cylinder 27 of the slider is able to translate forward and rearwardly along the slot 20 and to rotate about the axis 26.

The upper part of the slider hook portion 28 has a cam or lead-in surface 29 to assist the user in loading a blade cartridge into the sub-seat. A suitable ejector mechanism may also be provided for removing an installed blade cartridge from the sub-seat, and in FIG. 4 such mechanism is shown to include an ejector button 51 fixed to the slider 25 which may be pulled rearwardly by the user's thumb or finger to move the slider rearwardly or to the right in FIG. 4 to disengage the cylindrical hook from the blade assembly.

Figure 5:
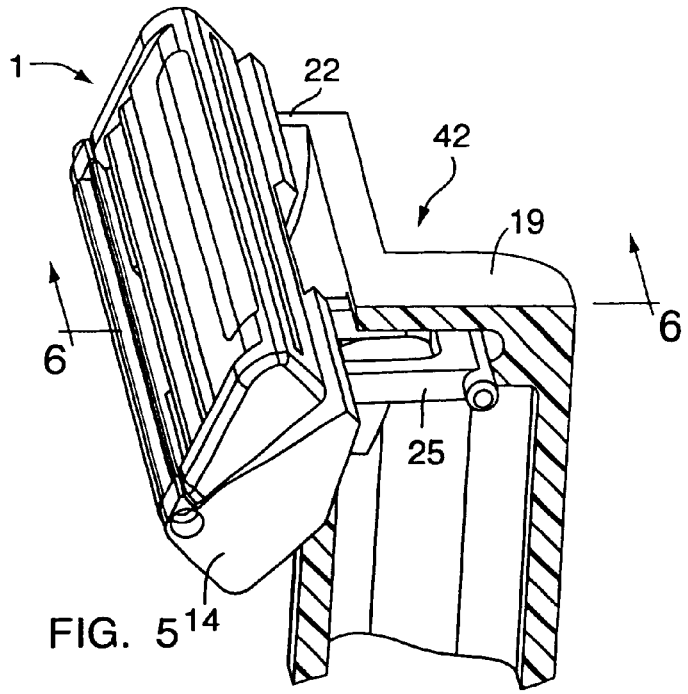
FIG. 5—A fragmentary perspective view of the reusable assembly of FIG. 3 with the blade cartridge of FIG. 1 installed in the assembly.

FIGS. 5, 6 and 7 show the complete shaving razor formed by the blade cartridge 1 of FIG. 1 having been installed in the reusable assembly of FIGS. 3 and 4 as a result of the blade cartridge having been moved generally perpendicularly relative to the length dimension of the sub-seat 14 and its guard element 15. In FIGS. 5 and 6, the cartridge 1 and the sub-seat 14 are shown in their neutral or counterclockwise limited positions relative to the sub-seat 14 and the housing 19 respectively. In this installed condition of the cartridge 1, the cartridge cylindrical portion 5 is mated with the lower cylindrical surface 47 of the sub-seat recess 17, the sub-seat surface 47 and the outer surface of the cylindrical portion 5 of the cartridge having substantially equal diameters so that as a result of the co-engagement between the sub-seat surface 47 and the cylindrical portion 5, the blade cartridge 1 is held in the sub-seat for rotation about the axis 18 which becomes a cartridge pivot axis about which the cartridge is pivotal relative to the sub-seat. The cartridge is held in its installed position by the hook portion 28 of the slider 25, and as the cartridge is inserted into the sub-seat, the cylindrical portion 5 of the cartridge engages the lead-in surface 29 of the slider causing the slider to be cammed rearwardly or to the right in FIG. 4 to allow the cylindrical cartridge portion to move past the hook portion 28 with the result that the hook portion 28 thereafter snaps forwardly again under the action of the springs 45 to the position shown in FIGS. 4 and 6 to hold the cylindrical portion in the recess 17. The hook portion 28 of the slider 25, the bottom surface 47 of the sub-seat recess 17, and the cylindrical portion 5 of the blade cartridge, are all cooperating catch parts enabling the blade cartridge 16 to be moved into and out of its installed position relative to the reusable assembly 42 and to be held in such position until intentionally released.

A suitable spring means is provided between the sub-seat 14 and the installed blade cartridge 1 to bias the cartridge about the axis 18 to the counter clockwise limited position shown in FIG. 6. Such spring means may take various different forms and, by way of example, in FIG. 3 are shown to comprise two leaf springs 53 carried by the sub-seat 14 which springs 53 come into engagement with the blade cartridge as the blade cartridge is moved into its installed position with the springs thereafter urging the sub-seat to its counterclockwise limit position relative to the sub-seat and resiliently resisting its clockwise movement from the counterclockwise limit position.

FIG. 7 shows the razor of the invention with the sub-seat 14 and the blade cartridge 1 both moved to their clockwise limit positions relative to the cartridge and the sub-seat respectively, this condition being one arrived at under maximum applied shaving forces. In this condition, the sub-seat 14 has rotated clockwise about the axis 16 from the position shown in FIG. 6 causing the slider cylinder 27 to translate along the housing slot 20 and to rotate about the axis 26 in a counterclockwise direction. The blade cartridge 1 has also rotated about the axis 18. Preferably the sub-seat 14 is designed to have about 40° of pivotal freedom of movement about the axis 16 relative to the housing 19, as represented by the angle A of FIG. 6; and the blade cartridge 1 is preferably designed to have approximately 10° of pivotal freedom of movement about the axis 18 relative to the sub-seat 14 as represented by the angle B of FIG. 6. In practice, however, the blade cartridge 1 may be designed to have a pivotal excursion of only about 3° about the axis 18 relative to the sub-seat 14 in response to normal shaving forces. Further, the spring element or elements provided between the housing 19 and the sub-seat 14 are preferably designed to be less stiff than the spring elements between the sub-seat 14 and the blade cartridge 1 so that the blade cartridge does not begin to rotate relative to the sub-seat 14 until the sub-seat reaches a substantial degree of displacement from its counterclockwise limited position. In particular, the springs are preferably so designed that the blade cartridge does not begin to rotate about the axis 18 until the sub-seat has rotated about the axis 16 to a position located about mid-way between its counterclockwise and clockwise limited positions.

From the above description, it will be understood that the invention provides a shaving razor using a replaceable shaving cartridge of simplified construction where the guard element of the razor is permanently attached to the reusable assembly of the razor. This guard member has a very low wear rate compared to the blade edges of the blade cartridge and to a shaving aid mounted to the cap of the blade cartridge and, therefore, the invention takes advantage of the guard member not having to be replaced every time a new blade cartridge is installed into the reusable assembly. The invention also provides the blade cartridge with a second pivoting motion about an axis coaxial to a known first pivoting motion to provide additional safety to the user. Under excessive shaving forces, the blade cartridge and its blade elements are able to pivot relative to the guard member away from the plane of the user's skin. Still further, the invention improves and simplifies the blade cartridge installation process since the attachment point for the blade cartridge to the reusable assembly of the razor is a single feature in the center of the blade cartridge which is easily insertable into a large receiving recess of the sub-seat. The connecting features of the blade cartridge and of the reusable assembly are also relatively larger than those provided with prior replaceable cartridge razors, and this among other things aids visual recognition of the connecting features by the user.

In the embodiment of the invention as described above, the blade cartridge 1 and the reusable assembly 42 are so designed that, when the blade cartridge is installed in the reusable assembly, the cartridge is spring biased about the cartridge pivot axis 18 relative to the sub-seat 14 to a counterclockwise limited position and is movable clockwise about the pivot axis 18 against the biasing force of the associated spring means. The invention in its broader aspects is not, however, limited to this particular design in regard to the pivotal movement and biasing of the blade cartridge, and instead, if desired, the blade cartridge and the reusable assembly may be designed so that the blade cartridge is biased in a clockwise direction about its pivot axis relative to the sub-seat toward a clockwise limited position and is movable in the counterclockwise direction away from the clockwise limited position against the biasing force of the associated spring means. In this case, the pivot axis for the movement of the blade cartridge relative to the sub-seat is preferably located in the vicinity of the cap of the cartridge rather than at a position below the blade or blades of the blade cartridge as is the case in the previously described embodiment of FIGS. 1–7.

Figure 8:
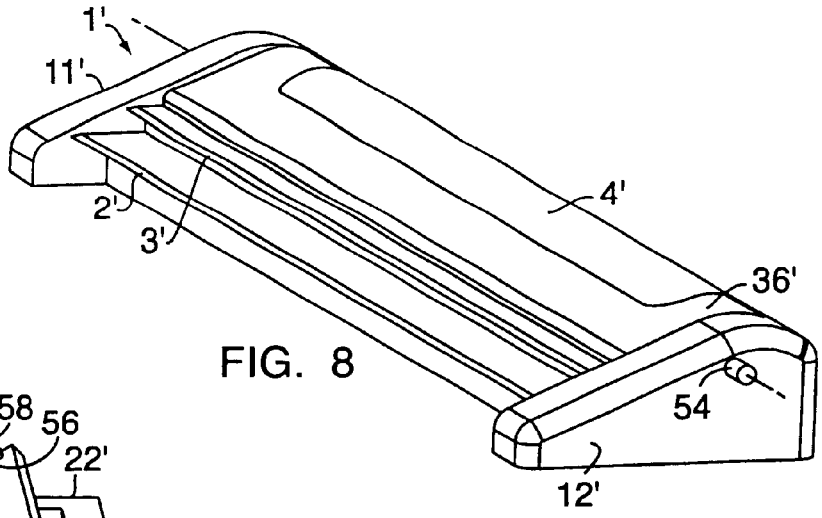
FIG. 8—A perspective view of a blade cartridge according to a further embodiment of the invention.
Figure 9:
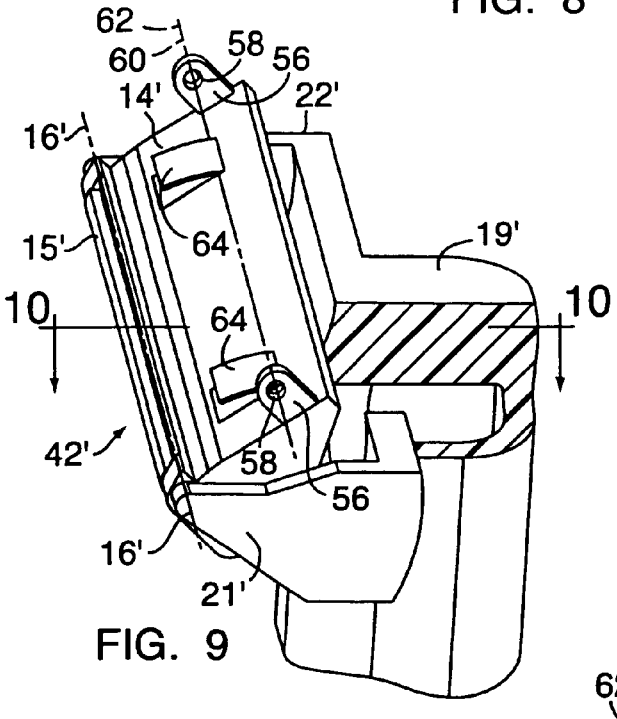
FIG. 9—A perspective view of a reusable assembly usable with the blade cartridge of FIG. 8, with portions of the assembly being broken away to reveal the structure of other parts.
Figure 10:
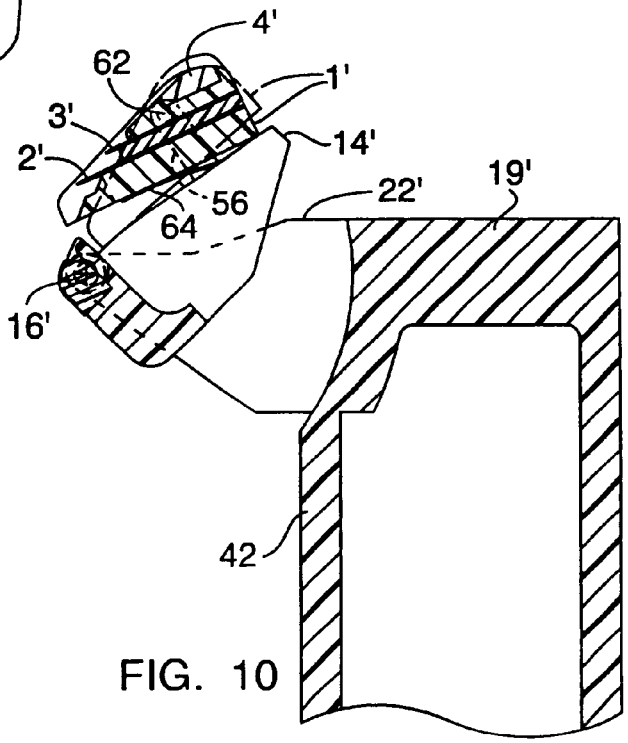
FIG. 10—A vertical sectional view taken on the line 10—10 of FIG. 9 and with the blade cartridge of FIG. 8 being shown assembled with the reusable assembly of FIG. 9.

FIGS. 8, 9 and 10 show a blade cartridge and reusable assembly according to a further embodiment of the invention which provides for a clockwise biasing of the blade cartridge about its pivot axis relative to the sub-seat. In the embodiment shown by these figures, various parts are substantially identical to corresponding parts of the embodiment of FIGS. 1–7 and in FIGS. 8, 9 and 10 have been given the same reference numbers as in FIGS. 1–7 except for being primed. Further full description of these parts is, therefore, not made in the following description of FIGS. 8, 9 and 10.

Referring to FIG. 8, the illustrated blade cartridge 1' has a cylindrical stub 54 extending laterally outwardly from each of its end walls 11' and 12'. Only one of the cylindrical stubs 54 is shown in FIG. 8, but both are identical in size and are concentric about a common axis 10' fixed relative to the cartridge 1'.

As shown in FIG. 9, the reusable assembly 42' has a sub-seat 14' which is pivotal relative to the remainder of the reusable assembly 42' about the axis 16'. To receive and support a blade cartridge 1', the sub-seat 14' has respectively at each of its lateral ends an upstanding support arm 56 with an opening 58 complementary to the stubs 54 of the blade cartridge 1', with the holes 58 being concentric about a common axis 60 parallel to the axis 16'. The inboard faces of the arms 56 are spaced from one another by a distance substantially equal to the distance between the outboard faces of the end walls 11' and 12' of the blade cartridge 1'. FIG. 9 shows the support arms 56 in their neutral unstressed condition, and the arms are sufficiently springy that they can be spread apart enough to allow the blade cartridge 1' to be inserted onto the sub-seat 14' with the two stubs 54 of the blade cartridge 1' snapping into the holes 58 of the support arms 56. When the two stubs 54 are received in the two holes 58, the axis 10' of the blade cartridge becomes collinear with the axis 60 of the sub-seat 14' and together form a pivot axis 62 about which the blade cartridge 1' is pivotal relative to the sub-seat 14'.

The sub-seat 14', as shown in FIG. 9, also carries two leaf springs 64, and when the blade cartridge 1' is assembled with the sub-seat 14' by snapping of the stubs 54 of the cartridge 1' into the holes 58 of the sub-seat 14, the springs 64 engage the bottom of the cartridge 1' and bias the cartridge in the clockwise direction about the pivot axis 62 to a clockwise limited position, defined by engagement of the cartridge 1' with the sub-seat 14'.

FIG. 10 shows the cartridge 1' in its installed position relative to the sub-seat 14' of the reusable assembly 42'. In this illustration, the blade cartridge 1' is shown in the clockwise limited position to which it is urged by the leaf springs 64, and from this position the cartridge 1' is movable counterclockwise about the axis 62 relative to the sub-seat 14' against the biasing force of the springs 64 to a counterclockwise limited position shown by the broken lines in FIG. 10.

As is the case in the embodiment of FIGS. 1–7, in the embodiment according to FIGS. 8, 9 and 10, the first spring means between the housing 19' and the sub-seat 14' and the second spring means between the sub-seat 14' and the blade cartridge 1' are so related that in response to shaving forces imposed on the cutting edges 2' and 3' of the blades, the sub-seat 14' will first pivot about the pivot axis 16' relative to the housing 19' before the blade cartridge 1' will start to move about the pivot axis 62 relative to the sub-seat 14', and preferably the springs are so related that the blade cartridge 1' does not begin to rotate about the axis 62 until the sub-seat 14' has rotated about the axis 16' to a position located about midway between its counterclockwise and clockwise limited positions.

It should also be noted that in the illustrated blade cartridges 1 and 1' the number of blades contained in each of those cartridges has by way of example been shown to be two blades, but this is not a limitation and in keeping with the invention the number of blades per cartridge may vary from one blade per cartridge to any practical higher number of blades (perhaps as many as five or more) per cartridge.

What is claimed is:

1. A shaving razor comprising:

a reusable assembly including an elongated guard element having a length dimension and which assembly is movable by a user's hand in a shaving direction generally perpendicular to the length dimension of the guard element, and a replaceable blade cartridge with at least one blade having an elongated cutting edge, said reusable assembly and blade cartridge having cooperating catch parts enabling the blade cartridge to be brought into and out of an installed condition relative to the reusable assembly with accompanying movement of the blade cartridge toward and away from the assembly in a direction generally perpendicular to said length dimension of the guard element, and said cartridge when in said installed condition having said cutting edge located parallel to and behind said guard element with respect to the shaving direction so that said guard element can engage and stretch the user's skin in advance of the cutting edge during a shaving operation.

2. A shaving razor as defined in claim 1, wherein:

said replaceable blade cartridge also includes a shaving aid so located that during a shaving operation said shaving aid can engage and pass over an area of the user's skin also passed over by the cutting edge.

3. A shaving razor as defined in claim 1, wherein:

said reusable assembly includes an elongated sub-seat to which the elongated guard element is fixed and having a top surface, said blade cartridge having a plastic seat with a seat body located below said blade, said cartridge seat body in the said installed condition of the cartridge being located above said sub-seat top surface, and said cooperating catch parts including a recess in said sub-seat extending downwardly from said sub-seat top surface and a connector protrusion extending downwardly from the cartridge seat body which connector protrusion in said installed condition of the cartridge is received in said sub-seat recess.

4. A shaving razor as defined in claim 3, wherein:

said cartridge seat body has a forward edge parallel to and spaced rearwardly of the blade cutting edge.

5. A shaving razor as defined in claim 3, wherein:

said catch parts include a slider forming part of said reusable assembly and slidable horizontally relative to said recess between a first position at which the slider is engageable with the connector protrusion of the blade cartridge when the cartridge is installed in said reusable assembly to hold said blade cartridge in said sub-seat and a second position at which the connector protrusion of the blade cartridge is freed for movement into and out of said sub-seat to enable the removal and replacement of the blade cartridge with respect to the reusable assembly.

6. A shaving razor as defined in claim 3, wherein:

said reusable assembly includes a housing which carries and supports the sub-seat for pivotal movement of the sub-seat relative to the housing about a sub-seat pivot axis parallel to said cutting edge.

7. A shaving razor as defined in claim 6, wherein:

said guard element is generally arcuate about a guard axis parallel to the cutting edge, and said guard axis and said sub-seat axis are at least approximately collinear.

8. A shaving razor as defined in claim 6, wherein:

said blade cartridge when in said installed condition relative to the reusable assembly is pivotal relative to the sub-seat about a cartridge pivot axis parallel to said cutting edge and spaced from the sub-seat pivot axis.

9. A shaving razor as defined in claim 8, wherein:

said recess has a concave bottom surface cylindrically arcuate about a bottom surface axis parallel to the guard element, and the connector protrusion of the cartridge seat has a lower portion with a convexly cylindrical outer surface arcuate about a cartridge lower portion axis parallel to and spaced downwardly from the blade cutting edge, said connector protrusion lower portion outer surface when the cartridge is in its installed position relative to the reusable assembly complementarily engaging the recess bottom surface so that said bottom surface axis and said cartridge lower portion axis substantially coincide with one another to define said cartridge pivot axis.

10. A shaving razor as defined in claim 8, wherein:

said sub-seat has a limited degree of pivotal freedom of movement about the sub-seat pivot axis relative to the housing, and the blade cartridge when in the installed condition relative to the reusable assembly has a limited degree of pivotal freedom of movement about the cartridge pivot axis relative to the sub-seat, a first spring means is included between the sub-seat and the housing for biasing the sub-seat counterclockwise about the sub-seat pivot axis relative to the housing, and a second spring means is provided between the blade cartridge and the sub-seat when the blade cartridge is in the installed position relative to the reusable assembly for biasing the blade cartridge counterclockwise about the cartridge pivot axis relative to the sub-seat.

11. A shaving razor as defined in claim 10, wherein:

said first spring means and said second spring means are so related to one another that during a shaving operation said sub-seat will move, by pivoting clockwise about the sub-seat pivot axis, a substantial angular distance away from a counterclockwise limit position before the blade cartridge will move, by pivoting about the cartridge pivot axis, away from a counterclockwise limit position relative to the sub-seat.

12. A shaving razor as defined in claim 5, wherein:

said slider is biased forwardly by a spring and has a forward portion normally located in said sub-seat recess, said forward portion of the slider having a cam surface engageable with the connector protrusion of the blade cartridge as the blade cartridge is moved into the installed position relative to the sub-seat so as to rearwardly displace the slider to allow a lower portion of the connector protrusion to move past the slider with the slider thereafter moving forward again under the action of the spring to hold the connector protrusion in the sub-seat recess.

13. A shaving razor comprising:

a reusable assembly including a handle and a housing at an upper end of the handle, and a replaceable blade cartridge with at least one blade having an elongated cutting edge, said reusable assembly including an elongated sub-seat having a top surface and supported by the housing for pivotal movement relative to the housing about a sub-seat pivot axis, the sub-seat and the blade cartridge having cooperating catch parts enabling the blade cartridge to be brought into and out of an installed condition relative to the sub-seat, and said blade cartridge when in said installed condition relative to said sub-seat being pivotal relative to said sub-seat about a blade cartridge pivot axis parallel to and spaced from said sub-seat pivot axis.

14. A shaving razor as defined in claim 13, wherein:

said sub-seat has a limited degree of pivotal freedom of movement about the sub-seat pivot axis relative to the housing, the blade cartridge in the installed condition relative to the reusable assembly has a limited degree of pivotal freedom of movement about the cartridge pivot axis relative to the sub-seat, a first spring means between the sub-seat and housing for biasing the sub-seat counterclockwise about the sub-seat pivot axis relative to the housing, and a second spring means is provided between the blade cartridge and the sub-seat when the blade cartridge is in the installed position relative to the sub-seat, for biasing the blade cartridge in one direction about the cartridge pivot axis relative to the sub-seat.

15. A shaving razor as defined in claim 14, wherein:

said one direction in which the blade cartridge is biased by the second spring means about the cartridge pivot axis is a counterclockwise direction.

16. A shaving razor as defined in claim 14, wherein:

said one direction in which the blade cartridge is biased by the second spring means about the cartridge pivot axis is a clockwise direction.

17. A shaving razor as defined in claim 15, wherein:

said first spring means and said second spring means are so related to one another that during a shaving operation said sub-seat will move, by pivoting clockwise about the sub-seat pivot axis, a substantial angular distance away from a counterclockwise limit position before the blade cartridge will move, by pivoting about the cartridge pivot axis, away from a counterclockwise limited position relative to the sub-seat.

18. A shaving razor as defined in claim 15, wherein:

said first spring means and said second spring means are so related to one another that during a shaving operation said sub-seat will move, by pivoting clockwise about the sub-seat pivot axis, a substantial angular distance away from a counterclockwise limit position before the blade cartridge will move, by pivoting about the cartridge pivot axis, away from a clockwise limited position relative to the sub-seat.

19. A replaceable shaving cartridge for use as part of a shaving razor, said cartridge comprising:

a plastic seat having a horizontal elongated seat body, and a horizontally elongated blade located on top of and fixed relative to the seat body and having a cutting edge extending along a length dimension of the blade, the plastic seat having a connector protrusion extending downwardly from the seat body and having a lower portion with a convexly cylindrical outer surface arcuate about a cartridge lower portion axis parallel to and spaced downwardly from the blade cutting edge, and wherein no elongated guard element extending parallel to the cutting edge and located forwardly of the cutting edge is part of the cartridge, and said cartridge includes an elongated shaving aid located parallel to and behind the cutting edge so that during a shaving operation with said cartridge said shaving aid can engage an area of the user's skin immediately after that area has been passed over by the cutting edge.

20. A replaceable shaving cartridge for use as part of a shaving razor as defined in claim 19, wherein:

said cartridge seat body has a forward edge parallel to and spaced rearwardly of the blade cutting edge.

21. A replaceable shaving cartridge as defined in claim 19, wherein:

said cartridge lower portion axis is located at least approximately in a vertical plane containing the cutting edge.

* * * * *